United States Patent [19]

Witt

[11] Patent Number: 4,752,030

[45] Date of Patent: Jun. 21, 1988

[54] MAILBOX INDICATOR

[76] Inventor: Paul L. Witt, Rte. 1, Libertyville, Iowa 52567

[21] Appl. No.: 41,202

[22] Filed: Apr. 22, 1987

[51] Int. Cl.[4] ..... B65D 91/00

[52] U.S. Cl. ..... 232/35

[58] Field of Search ..... 232/35, 34, 17

[56] References Cited

U.S. PATENT DOCUMENTS

| | | | |
|---|---|---|---|
| 908,543 | 1/1909 | Brown | 232/34 |
| 2,498,260 | 2/1950 | Fabis | 232/34 |
| 2,988,268 | 6/1961 | Mioduski | 232/35 |
| 3,602,424 | 8/1971 | Raulston | 232/35 |
| 3,648,924 | 3/1972 | Burns | 232/35 |
| 4,150,780 | 4/1979 | Mapes | 232/35 |
| 4,190,193 | 2/1980 | Smith | 232/35 |
| 4,290,549 | 9/1981 | Getz | 232/35 |
| 4,318,507 | 3/1982 | Thopsey et al. | 232/35 |
| 4,492,335 | 1/1985 | Davis | 232/35 |

*Primary Examiner*—Robert W. Gibson, Jr.

[57] ABSTRACT

The mailbox indicator is a device intended for attachment on a mailbox. It includes a support arm for side of mailbox and a signal arm with flag for front of mailbox. The signal arm rests horizontally on support arm providing visual indication that mail has not been delivered. When the mailbox door is opened, the signal arm drops to vertical position with flag end down and provides visual indication that mail has been delivered.

2 Claims, 1 Drawing Sheet

MAILBOX INDICATOR

SUMMARY OF INVENTION

The mailbox indicator is a device designed to provide a simple visual signal as to whether or not the mailman has delivered the mail. Although there are several signal devices previously patented for mailboxes, the mailbox indicator is unique in simplicity. It also is easily distinguishable from the standard mail pickup flag.

Another objective of the mailbox indicator is to promote safety of rural people who risk crossing roadways, sometimes in hazardous weather, to check their mailboxes for delivery. With a mailbox indicator on each mailbox, people can save unnecessary trips to and from their mailboxes.

The mailbox indicator can be easily installed to new mailboxes or already existing mailboxes. It has two main parts. One is the pivotal signal arm with a flag on one end. The signal arm is attached to front or door of mailbox. The second part is a short protruding support arm attached to either side of the mailbox. The signal arm rests on the protruding support arm on a horizontal plane with the mailbox. When the mailbox door is opened, the signal arm slides off the support arm, drops from gravitational pull to a vertical position with flag downward, thus indicating mail delivery.

There are several advantages of the mailbox indicator over most other mailbox signalling devices. It requires fewer parts and is more easily installed than those designed by Burns U.S. Pat. Nos. 3,648,924 and Smith 4,190,193 and Thopsey 4,318,507.

The broad face of the mailbox indicator's signal flag is easily seen facing the mailbox from a distance to the front or rear. Yet the narrow edge of the flag portion is not easily seen by persons trafficing the road, thereby avoiding possible confusion with road signs or markers. In contrast, the signal flag of Raulston U.S. Pat. No. 3,602,424 is more easily seen from the side of the mailbox and could cause confusion for motorists.

Several previous devices, such as Getz U.S. Pat. Nos. 4,290,549 and Smith 4,190,193 have signal flags which move to upward position after mail has been delivered. Since the mailbox indicator has a flag which drops downward instead, it is less likely to be confused with the mail pickup flag already standard to mailboxes.

The Manian U.S. Pat. No. 4,363,439 has a flag that is most obvious when in downward position and viewed from front of mailbox. Since the mailbox indicator has a signal arm with the flag extending horizontally outward from the side of the mailbox. If the signal flag is visible prior to delivery from the side of the mailbox and is not easily visible after delivery in its downward position, perhaps due to the post on which the mailbox sits, then it can be deduced that mail has been delivered when signal flag is not in pre-delivery position.

Various changes could be made in the mailbox indicator by those knowledgable in the art. The size, shape, and color of the signal flag could vary. The signal and support arms could vary in length, width, manufactured material, and means of attachment to mailboxes. The support arm could also be installed on either side of the mailbox, depending on ease of view for the owner.

DETAILED DESCRIPTION

Figure 1:
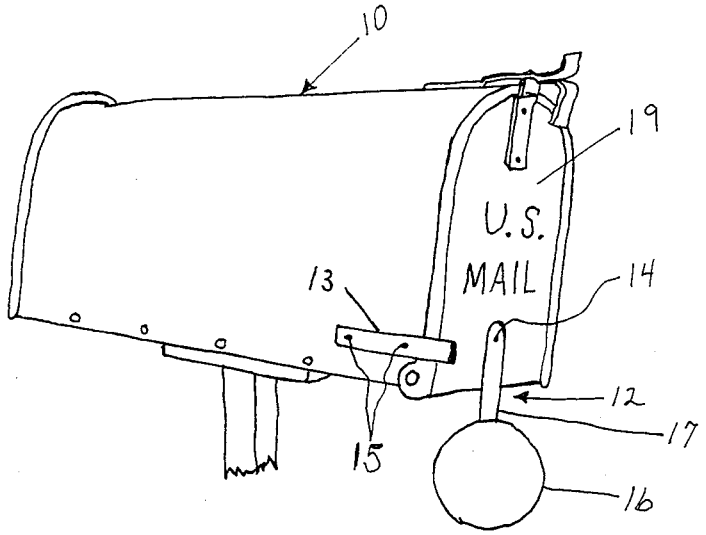
FIG. 1 is a perspective view of a rural mailbox having a mailbox indicator, in accord with the present invention, mounted thereon.

FIG. 1 shows the present invention as mounted on a rural type mailbox 10. The invention signal flag arm 12 consists of an arm 17 with signal flag 16 at end of said arm (or signal arm and flag could be one piece) and a protruding support arm 13. Signal arm member 17 is mounted on front of mailbox door 19 at point 14. Signal arm 17 is to pivot at mounting point 14.

Figure 2:
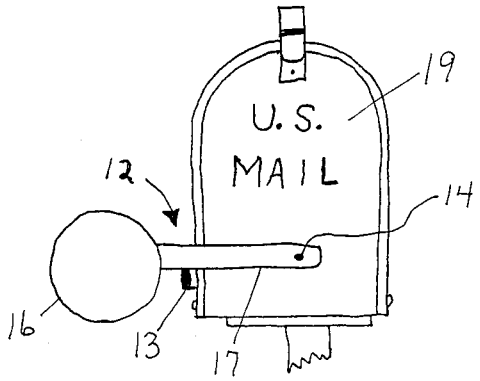
FIG. 2 is a front view of the mailbox shown in FIG. 1 with mailbox indicator in horizontal non-delivery position.

After signal arm 17 is mounted on the mailbox door, it is held in a horizontal position as in FIG. 2 by a protruding support arm 13 secured to side of mailbox with fasteners 15.

Figure 3:
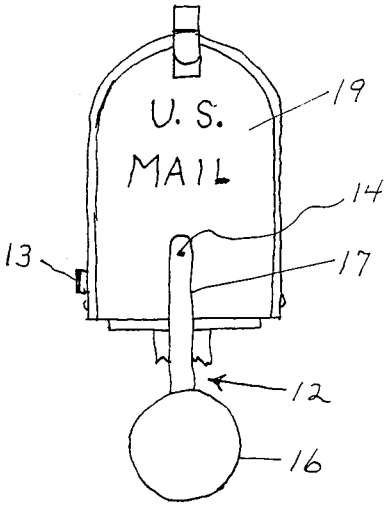
FIG. 3 is a front view of the mailbox shown in figures 1 and 2 with mailbox indicator's signal arm in dropped vertical mail delivered position.

In use the signal flag arm device shown in FIGS. 1–3 operate as follows. With mailbox door open, the flag end of signal arm 17 is moved toward curved end of door. With arm in this position, door is closed and said signal arm is lowered to rest on protruding support arm 13. The signal flag arm device is now held in a horizontal position (or mail undelivered) as in FIG. 2. When the mailbox door is opened, as by the mailman in making a mail delivery, the signal flag arm slides off the protruding support arm. Thus being released from support, the signal flag arm swings downward by gravitational pull into a vertical or mail delivered position as in FIG. 3.

I claim:

1. A mailbox signal for rural mailboxes of the type having a tubular body and a pivotal door across one end comprising; a pivoting signal arm having a flag at one end; a support arm supported by a side of said mailbox and protruding beyond the door of said mailbox; a pivot pin through said door in operative support of said signal arm, and pivotal to rest position against said protrusion of said support arm when said door is closed, where by upon opening said door said signal arm with flag end will pivot on said pivot pin and drop downward to indicate that said door was opened and said signal flag arm will remain in downward position when said door is shut and will not interfere with mail delivery.

2. A mailbox signal for a rural mailbox having a tubular body and pivotal door opening and closing at one end comprising; a visual signal pivotal upon said door of said mailbox in a plane parallel to the facing of said door; and stop means extruding from selected of the sides of said mailbox in selected interference with said pivotal visual signal viewed from said door where by upon opening said door said visual signal drops downward pivotally carried by said door and indicating that said door has been opened.

* * * * *